US005653628A

United States Patent [19]

Weihrauch

[11] Patent Number: 5,653,628

[45] Date of Patent: Aug. 5, 1997

[54] DEVICE FOR ROUNDING THE ENDS OF PLASTIC BRISTLES

[75] Inventor: Georg Weihrauch, Wald-Michelbach, Germany

[73] Assignee: Coronet-Werke GmbH, Wald-Michelbach, Germany

[21] Appl. No.: 582,627

[22] Filed: Jan. 4, 1996

[30] Foreign Application Priority Data

Jan. 4, 1995 [DE] Germany ..... 195 00 145.1

[51] Int. Cl.[6] ..... B24B 33/00

[52] U.S. Cl. ..... 451/540; 300/17; 451/716; 451/552

[58] Field of Search ..... 451/180, 181, 451/552, 59, 121, 555, 540, 916; 300/15, 17

[56] References Cited

U.S. PATENT DOCUMENTS

| | | | |
|---|---|---|---|
| 2,141,823 | 12/1938 | Postma | 451/181 |
| 3,188,674 | 6/1965 | Hobbs | 451/180 |
| 3,233,943 | 2/1966 | Peterson | 300/17 |
| 3,451,173 | 6/1969 | Hazelton | 300/17 |
| 4,001,982 | 1/1977 | Griffin et al. | 451/552 |
| 4,179,856 | 12/1979 | Wheeler | 451/552 |
| 4,738,055 | 4/1988 | Jackson et al. | 451/180 |
| 4,785,586 | 11/1988 | Kratfel | 451/552 |
| 4,815,507 | 3/1989 | O'Rourke | 451/180 |

FOREIGN PATENT DOCUMENTS

| | | |
|---|---|---|
| 0 438 935 | 7/1991 | European Pat. Off. . |
| 41 41 372 | 6/1993 | Germany . |

*Primary Examiner*—James G. Smith
*Assistant Examiner*—Derris H. Banks
*Attorney, Agent, or Firm*—Antonelli, Terry, Stout & Kraus, LLP

[57] ABSTRACT

A device for rounding the ends of plastic bristles on rotationally symmetrical circular brushes has a tool in the form of a rotationally symmetrical hollow body with an abrasive inner surface, which has an inner contour with an at least zonally smaller cross-section than the circular brush corresponding to the outer contour of the latter and between the circular brush and the tool there is a relative rotary movement and a reversible relative axial movement.

12 Claims, 3 Drawing Sheets

DEVICE FOR ROUNDING THE ENDS OF PLASTIC BRISTLES

FIELD OF THE INVENTION

The invention relates to a device for rounding the ends of plastic bristles on rotationally symmetrical circular brushes having an abrasively acting tool.

BACKGROUND OF THE INVENTION

Plastic bristles are cut to length from a continuous monofilament. Ideally the surface of cut is planar and perpendicular to the bristle axis. However, particularly when cutting bundles, frequently diagonal cuts occur and there may even be burr or flash formation on the surface of cut. For many applications such sharp-edged bristles are unusable or at least undesired. Therefore the ends of the bristles are worked or treated, so as to break the edges and in the ideal case obtain a spherical bristle top.

Essentially three methods are available for working the bristle ends, namely the chemical treatment thereof with suitable solvents, the thermal melting of the bristle ends and mechanical, abrasive working by grinding. In practice, the latter method has been largely adopted. The tool used consists of abrasive disks. This working of the bristle ends takes place on the finished brush on which the bristles are arranged in bundles. So as to be able to effectively treat or work the individual bristle end, the tool working surface on the bristle end must constantly change. This takes place by relative movements of brush and tool in different directions and by a profiling of the tool, or so that at least in the vicinity of the ends the bundles are divided up by spreading the bristles (DE 41 41 372 A1).

Although relatively satisfactory results can be obtained in this way in the case of brushes, whose bristle ends are located on a planar or only slightly curved envelope, this is not the case with circular brushes, particularly with so-called turned circular brushes, in which the bristles are optionally held in several layers between two twisted, central wires and the bristle ends are located on a cylindrical surface or on a conical surface. This construction is e.g. chosen for interdental brushes and mascara brushes due to the necessarily small cross-section of the bristle support, but also for massage brushes, bottle brushes, etc.

It has already been proposed in connection with circular brushes (DE 41 41 372 A1) to rotate the brush in spaced manner between two substantially parallel heating plates or to insert same in cylindrical holes of a heated tool, followed by rotation (EF 438 935 B1). In this case the spacing between the bristle ends and the heated surface, their temperature and the residence time of the circular brush in the tool must be very carefully matched to one another to ensure that the radiant heat is uniformly applied to the bristles. This is not possible in the case of parallel heating plates, because the surface temperature decreases towards the open sides of the tool and is not possible with cylindrical holes, because the heat accumulates in the hole and rises from the hole opening to the hole bottom. The major disadvantage of all thermal working and treatment processes, is the inadequate quality of the work result. The bristle ends must at least be heated to such an extent that the plastic passes into the melted state. It would be desirable if only the cut edge was melted down. However, this is not possible in practice, because such a precise temperature control is impossible. As the bristle diameter is sub ject to fluctuations due to the molecular structure of the plastic monofilament this necessarily leads to a different melting depth. To this must be added that any thermal action leads to the dissolving of the linearly oriented molecular structure. Thickened parts of non-uniform thickness form. In addition, at the bristle end the plastic loses its elastic characteristics, i.e. the bristle end becomes harder and breaks off after a short period of use.

The problem of the invention is to propose a device for the mechanical working of the bristle ends on circular brushes, which permits the manufacture of uniformly rounded bristle ends.

SUMMARY OF THE INVENTION

According to the invention this problem is solved in that the tool is a rotationally symmetrical hollow body with an abrasive inner face, which has an inner contour with an at least zonally smaller cross-section corresponding to the outer contour of the circular brush and that between the circular brush and the tool there is a relative rotary movement and a reversible relative axial movement.

As a result of the at least zonally smaller cross-section of the inner contour of the tool compared with the outer contour of the circular brush (and it can obviously also be smaller over the entire axial length), in conjunction with the rotary movement and reversible axial movement, it is ensured that the working surface of the tool comes into engagement with the ends of all the bristles of the circular brush. The bristles pass out of their stretched or extended position, so that as a result of the rotary and oscillating axial movement their ends are worked under constantly changing angles, which leads to a completely satisfactorily rounded bristle top. The working result or the contour of the bristle ends can be influenced by several parameters, namely the cross-sectional difference between the circular brush and the tool, so that the extent of the deflection of the bristles from the stretched position and therefore the working angle is determined by the number of rotations of the circular brush and/or tool and by the amplitude and period of the oscillating axial movement.

According to an embodiment also the rotary movement is reversible, .e. takes place in oscillating manner, so that during each working cycle the bristle is deflected in four directions, which are substantially perpendicular to one another. For roller-shaped, i.e. circular cylindrical brushes, the tool also has a circular cylindrical inner contour, whereas for conical circular brushes the tool is internally correspondingly conical.

According to another embodiment the tool has an internal diameter varying in the axial direction. In this case the working angle changes due to the axial movement in a continuous manner, in that the bristles are more strongly deflected in the vicinity of the smaller internal diameter of the tool than in larger diameter areas.

Similar results can be obtained in the rotation direction if the tool has an internal diameter varying in the circumferential direction.

In a practical embodiment the tool can have a wave profile or contour in the axial direction and optionally also in the circumferential direction. However, preferably there is a helical wave profile, which in conjunction with the linear and rotary movement leads to a deflection of the bristles in all the directions with also a varying deflection angle.

According to a further advantageous development the tool comprises at least two shell-shaped segments, which can be moved transversely to the axis between an open position, where they are spaced from one another, and a closed operating position.

The segments can be brought into the open position so as to more easily permit the insertion of the circular brush into the tool. In the open position the circular brush and/or the tool, optionally also between working operations, can be cooled or the tool can also be blown out, so as to remove dust-like abraded plastic material. A cyclic opening and closing of the tool can make the working of the bristle ends more effective.

Another embodiment is characterized in that the hollow body forming the tool is perforated and in this case the abraded dust is continuously removed. This can also be assisted in that the tool is subject to the action of compressed air over part of its axial length, so that simultaneously the tool and circular brush are cooled.

The invention is described in greater detail hereinafter relative to an embodiment and the attached drawings.

DETAILED DESCRIPTION OF EMBODIMENTS

Figure 1:
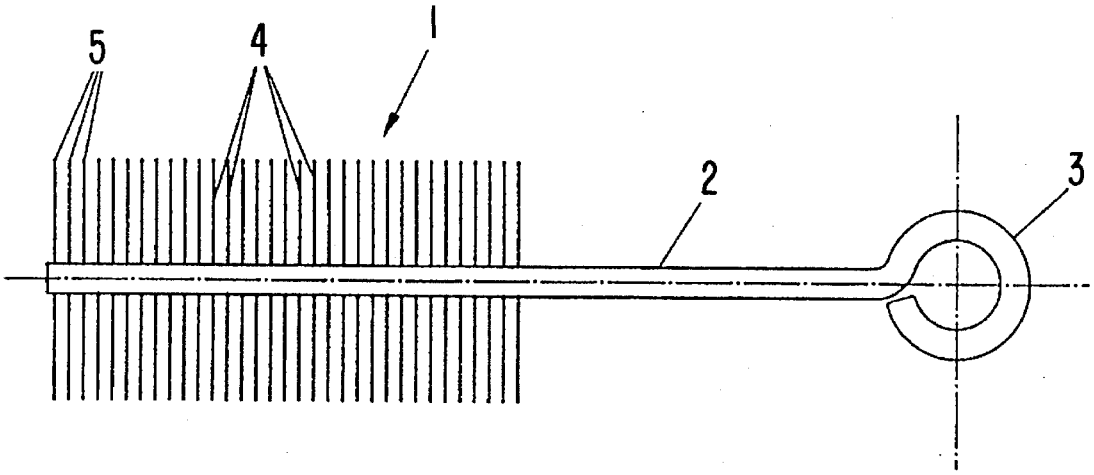
FIG. 1 shows a circular brush in a longitudinal view.
Figure 2:
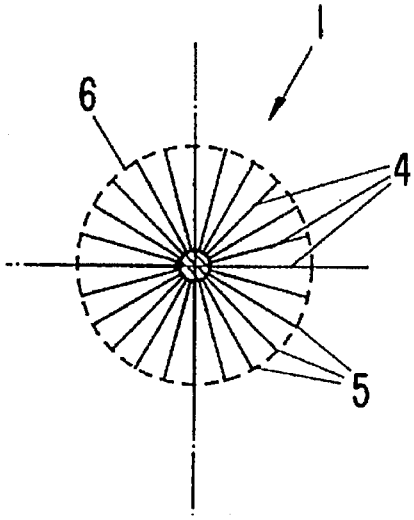
FIG. 2 shows the circular brush of FIG. 1 in a front view.

The circular brush 1 according to FIGS. 1 and 2 has a wire-like or rod-like support 2, optionally formed from two twisted round wires, with a grip part or handle 3. The identically long bristles 4 in uniform arrangement are arranged so as to project radially from the support 2, so that the bristle ends 5 are located on a cylindrical envelope 6, which simultaneously forms the working surface of the bristles 4.

For working purposes, particularly for rounding the bristle ends 5, there is provided a not shown device with a tool 7 in the form of a hollow cylinder 8, which has on its inner surface 9 an abrasively acting coating 10 in the form of a layer, a replaceable covering, etc. In the represented embodiment the internal diameter of the tool 7 is smaller over the entire axial length than the external diameter of the circular brush 1, so that when the bristles 4 are inserted in the tool 7, in the manner shown in FIG. 3, they are deflected or bent out of their stretched position counter to the axial movement direction indicated by the arrows.

Figure 3:
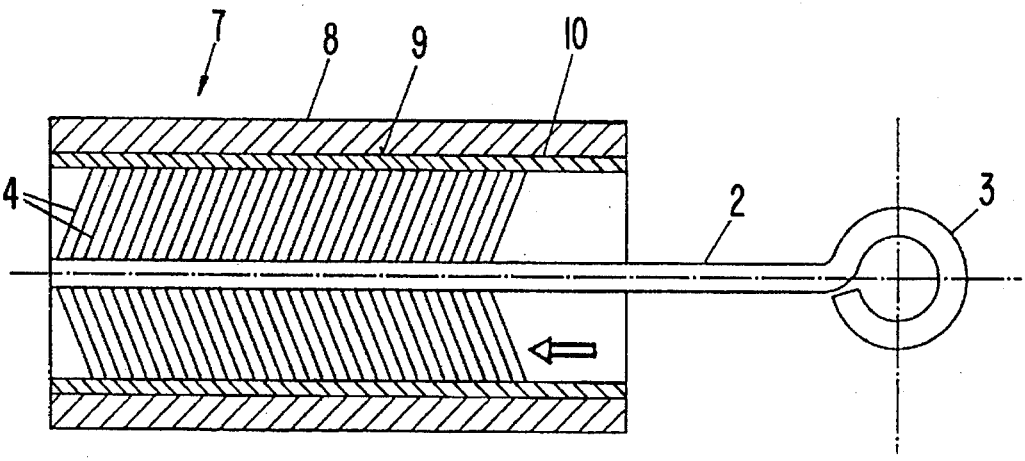
FIG. 3 shows the tool in axial section in a working phase.
Figure 4:
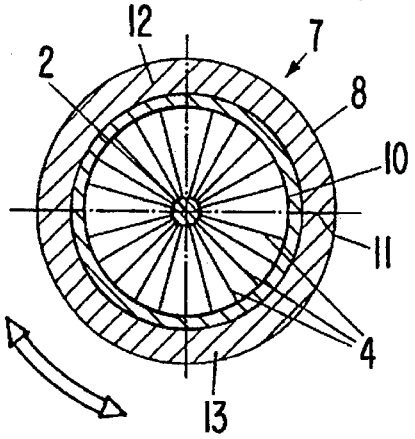
FIG. 4 shows the tool shown in FIG. 3 in cross-section.
Figure 5:
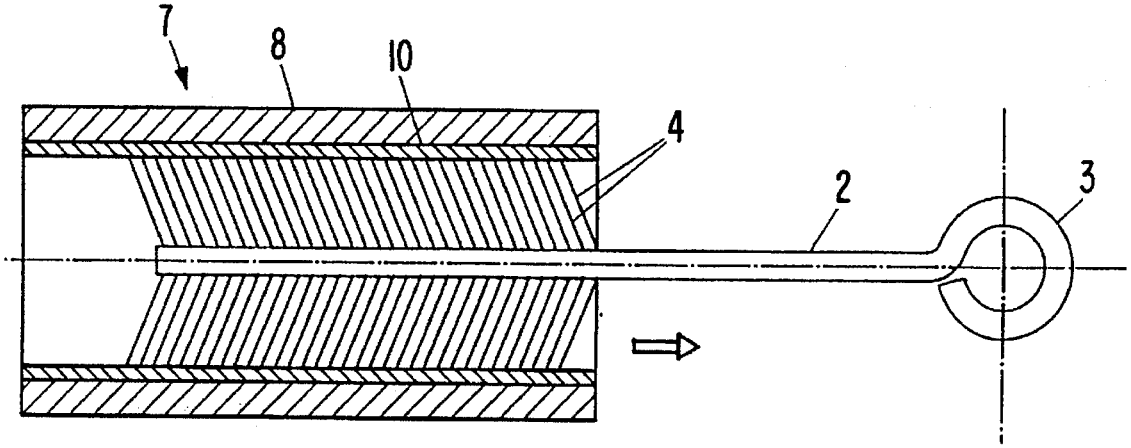
FIG. 5 shows the tool according to FIG. 3 in a further working phase.

The tool 7 or the circular brush 1 is coupled to an oscillating axial drive, whose working direction is indicated by the direction arrows in FIGS. 3 and 5. During this reciprocating movement the bristles 4 are alternately bent counter to the movement direction with respect to the support 2. At the same time the circular brush 1 or the tool 7 is given a preferably oscillating rotary movement, as indicated by the double arrow in FIG. 4. The bristles are bent counter to the rotary direction and the neutral position shown in FIG. 4. Therefore the bristle ends 5 in a continuously alternating manner are worked from four sides, so that they are regularly rounded after a certain operating time.

Figure 6:
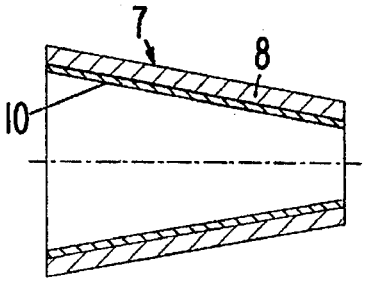
FIG. 6 shows a tool with a conical shape.

As circular brushes often have a conical shape the tool 7 may also have a conical inner shape as shown in FIG. 6.

Figure 7:
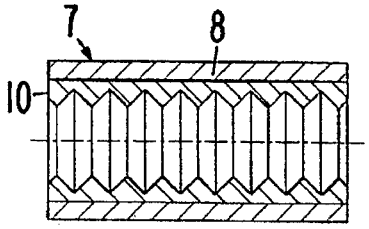
FIG. 7 shows a tool with a wave-like shape.
Figure 9:
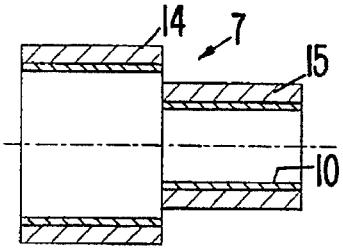
FIG. 9 shows a tool with a stepped shape.
Figure 8:
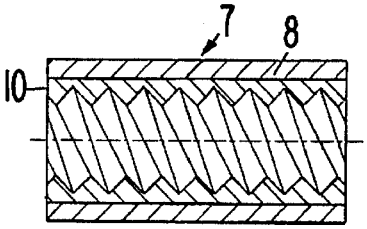
FIG. 8 shows a tool with a screw-like shape.
Figure 10:
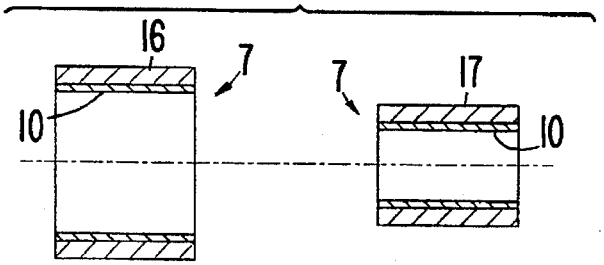
FIG. 10 shows a tool with two axial parts.

So that during the working of the bristles ends using the aforementioned working directions no undesired, non-circular symmetry is created at the bristle ends, the hollow cylinder 8 or covering 10 can additionally be profiled, e.g. in the form of a wave profile (FIG. 7) or a screw or helical profile (FIG. 8). There can also either be a two-step hollow cylinder 8 with a double working length 14, 15 (FIG. 9) or two separate hollow cylinders 16, 17 (FIG. 10) with in each case different internal diameters, so that the bristles are worked with different bending or deflection. The two separate cylinders according to FIG. 10 are preferably mounted on a common driving axle.

Figure 11:
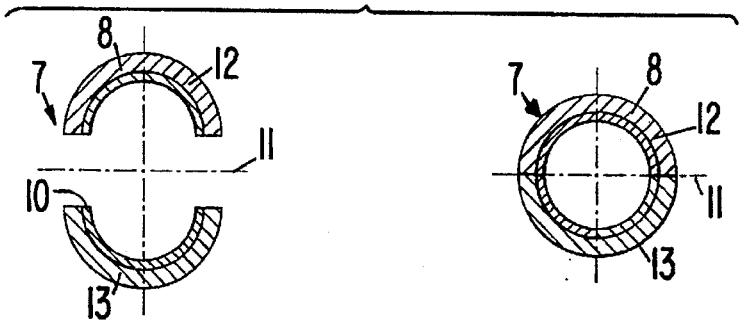
FIG. 11 shows a tool with two radial parts.

The hollow cylinder 8 can e.g. be split in a radial plane 11 and comprise two shell-shaped segments 12, 13, which in the closed operating position form a cylindrical inner surface (FIG. 11, right side). The segments can be brought into an open position perpendicular to the axis (FIG. 11, left side) and, optionally during working, can also be moved backwards and forwards between two positions, so that the bristles are deflected from the stretched position with constantly changing angles.

Figure 12:
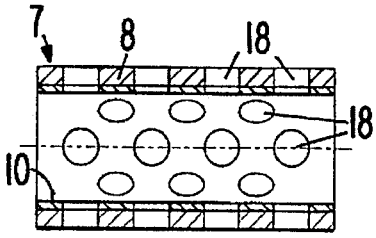
FIG. 12 shows a perforated tool.

In addition according to FIG. 12, the hollow body 8 and the covering 10 can be perforated in order to remove the bristle dust from the hollow body through the openings 18, which can be assisted by compressed or suction air action on part of the tool circumference. At the same time the tool and the circular brush would be additionally cooled by the air.

I claim:

1. Device for rounding the ends of plastic bristles on rotationally symmetrical circular brushes with an abrasively acting tool, characterized in that the tool has a rotationally symmetrical hollow body with an abrasive inner surface, which has an inner contour at least a zone of smaller cross-section corresponding to an outer contour of a circular brush and that between the circular brush and the tool there are a reversible relative rotary movement and a reversible relative axial movement.

2. Device according to claim 1, characterized in that the tool has a hollow body with a circular cylindrical inner contour adapted for rounding the ends of the plastic bristles of roller-like circular brushes.

3. Device according to claim 2, characterized in that the tool has a hollow body with an internal diameter, which over its entire axial length is smaller than an external diameter of the circular brush.

4. Device according to claim 1, characterized in that the tool has a hollow body with a conical inner contour adapted for rounding the ends of plastic bristles on conical circular brushes.

5. Device according to claim 1, characterized in that the tool has a hollow body with an internal diameter varying in an axial direction.

6. Device according to claim 1, characterized in that the tool has a hollow body with an inner contour varying in an circumferential direction.

7. Device for rounding the ends of plastic bristles on rotationally symmetrical circular brushes with an abrasively acting tool, characterized in that the tool has a rotationally symmetrical hollow body with an abrasive inner surface, which has an inner contour with at least a zone of smaller cross-section corresponding to an outer contour of a circular brush and that between the circular brush and the tool there are a relative rotary movement and a reversible relative axial movement and the tool has an abrasive inner surface with a wave profile extending in an axial direction.

8. Device for rounding the ends of plastic bristles on rotationally symmetrical circular brushes with an abrasively acting tool, characterized in that the tool has a rotationally symmetrical hollow body with an abrasive inner surface, which has an inner contour with at least a zone of smaller cross-section corresponding to an outer contour of a circular brush and that between the circular brush and the tool there are a relative rotary movement and a reversible relative axial movement and the tool has an inner contour with a helical profile.

9. Device for rounding the ends of plastic bristles on rotationally symmetrical circular brushes with an abrasively acting tool, characterized in that the tool has a rotationally symmetrical hollow body with an abrasive inner surface, which has an inner contour with at least a zone of smaller cross-section corresponding to an outer contour of a circular brush and that between the circular brush and the tool there are a relative rotary movement and a reversible relative axial movement and the tool has a hollow body in a two-step form with different internal diameters in each step, which are in each case smaller than an external diameter of the circular brush.

10. Device for rounding the ends of plastic bristles on rotationally symmetrical circular brushes with two abrasively acting tools, characterized in that each tool has a rotationally symmetrical hollow body with an abrasive inner surface, and that between the circular brush and the tool there are a relative rotary movement and a reversible relative axial movement and said two tools have different internal diameters, which are in each case smaller than an external diameter of the circular brush.

11. Device for rounding the ends of plastic bristles on rotationally symmetrical circular brushes with an abrasively acting tool, characterized in that the tool has a rotationally symmetrical hollow body with an abrasive inner surface, which has an inner contour with at least a zone of smaller cross-section corresponding to an outer contour of a circular brush and that between the circular brush and the tool there are a relative rotary movement and a reversible relative axial movement and the tool comprises a hollow body having at least two shell-shape segments, which can be moved transversely to a longitudinal axis of the tool between an open position, where the segments are spaced from one another and a closed operating position.

12. Device for rounding the ends of plastic bristles on rotationally symmetrical circular brushes with an abrasively acting tool, characterized in that the tool has a rotationally symmetrical hollow body with an abrasive inner surface, which has an inner contour with at least a zone of smaller cross-section corresponding to an outer contour of a circular brush and that between the circular brush and the tool there are a relative rotary movement and a reversible relative axial movement; the hollow body forming the tool being perforated.

* * * * *